US007432865B2

(12) United States Patent
Tsai et al.

(10) Patent No.: US 7,432,865 B2
(45) Date of Patent: Oct. 7, 2008

(54) ANTENNA AND PORTABLE DEVICE USING THE SAME

(75) Inventors: Feng-Ghi Eddie Tsai, Taipei Hsien (TW); Chia-Tien Li, Taipei Hsien (TW)

(73) Assignee: Wistron Neweb Corp., Sijhih (TW)

( * ) Notice: Subject to any disclaimer, the term of this patent is extended or adjusted under 35 U.S.C. 154(b) by 127 days.

(21) Appl. No.: 11/242,802

(22) Filed: Oct. 5, 2005

(65) Prior Publication Data

US 2006/0290574 A1 Dec. 28, 2006

(30) Foreign Application Priority Data

Jun. 28, 2005 (TW) ..... 94210868 U

(51) Int. Cl.
*H01Q 1/24* (2006.01)
*H01Q 1/38* (2006.01)

(52) U.S. Cl. ..... 343/702; 343/846

(58) Field of Classification Search ..... 343/700 MS, 343/702, 846, 795, 895
See application file for complete search history.

(56) References Cited

U.S. PATENT DOCUMENTS

| | | | | |
|---|---|---|---|---|
| 4,460,894 | A * | 7/1984 | Robin et al. | 343/700 MS |
| 5,521,606 | A * | 5/1996 | Iijima et al. | 343/713 |
| 6,087,988 | A * | 7/2000 | Pozgay | 343/700 MS |
| 6,133,881 | A * | 10/2000 | Kushihi et al. | 343/700 MS |
| 6,307,524 | B1 * | 10/2001 | Britain | 343/795 |
| 6,337,666 | B1 * | 1/2002 | Bishop | 343/795 |

* cited by examiner

*Primary Examiner*—Michael C Wimer
(74) *Attorney, Agent, or Firm*—Bacon & Thomas, PLLC

(57) ABSTRACT

An antenna with an adjustable grounding element and a related portable device is disclosed. The grounding element of the antenna according to the present invention includes a first section, a second section and a third section, wherein the first section is separately connected to the second section and the third section, such that a shape of the grounding element is substantially hollowed, such as an upside-down U shape. Alternatively, the grounding element further comprises a fourth section having an opening. By adjusting the grounding element or positions or sizes of the opening of the fourth section can obtain different radiation patterns.

14 Claims, 12 Drawing Sheets

ANTENNA AND PORTABLE DEVICE USING THE SAME

BACKGROUND OF THE INVENTION

1. Field of the Invention

The present invention relates to an antenna and a related portable device, and more particularly, to an antenna with different radiation patterns and a related portable device.

2. Description of the Related Art

Because portable communication devices are now so popular, antenna development is becoming increasingly important to support wireless communications between different portable communication devices. In particular, modern portable communication devices increased demand to achieve high antenna gains with small antenna structures.

Please refer to FIG. 1. Typically, an antenna 1 comprises a substrate 10 coated with a layer for a grounding element 11 and a layer for a radiating element 12. The grounding element 11 provides grounding function, and the radiating element 12 is used for transmitting and/or receiving signals. A coaxial cable 13 is separately electrically connected to the grounding element 11 and the radiating element 12 and feeds electronic circuit by a feed point 131.

The grounding element of the antenna is used to reduce signal/noise ratio (SNR) in the application system. Therefore, the grounding element 11 in the prior art antenna covers an entire block area; as shown in FIG. 1, a grounding element 11 in rectangular shape may be used for grounding function in the antenna 1. However, in such large block area of grounding element 11, it is hard to control the current distribution on the grounding element 11, and the typical solution is to make adjustments to the radiating element 12. In other words, in order to adjust the radiation pattern of the antenna 1, the structure of the radiating element 12 is needed to be changed, and this applies even to radiating elements 12 that have three-dimensional structures.

Therefore, it is desirable to provide an antenna and a related portable device to mitigate and/or obviate the aforementioned problems.

SUMMARY OF THE INVENTION

A main objective of the present invention is to provide an antenna with an adjustable grounding element for obtaining variable radiation patterns and a related portable device.

The antenna of the present invention comprises a substrate wherein the substrate having a radiating element and a grounding element electrically connected to each other. The grounding element has a first section, a second section and a third section, wherein the first section is separately connected to the second section and the third section. Therefore, the grounding element is substantially an upside-down U shape.

In another embodiment, the grounding element further comprises a fourth section connected to the second section or the third section, so the grounding element forms a shape with a breach. Alternatively, the fourth section is connected to the second section and third section so the grounding element forms a hollowed rectangular shape. Furthermore, the fourth section of the grounding element further comprises an opening that is located in a central region or two ends of the fourth section, so different positions for the breach and the opening can form different radiation patterns of the antenna.

In other embodiments, the radiating element and the grounding element are located on different surfaces. That is, the substrate has a first surface and a second surface; the first surface is located opposite to the second surface. The grounding element is mounted on the first surface and the radiating element is mounted on the second surface. Since the grounding element and the radiating element are separately mounted on difference surfaces of the substrate, the substrate may further comprise a conductive aperture, which is used to electronically connect the grounding element with the radiating element.

In different embodiments of the present invention, the grounding element may have different shapes to provide different radiation pattern, such as the second section or the third section of the grounding element may be larger than the first section, or the third section may be larger than the first; the second section or the third section of the grounding element may also be substantially arc-shaped; the second section or the third section of the grounding element have triangular shapes; the second section or the third section of the grounding element may have polygonal shapes (such as pentagonal). Alternatively, the second section or the third section of the grounding element can have different zigzagged shapes. In a preferred embodiment, a total length of the second section or the third section is substantially a quarter wavelength ($\lambda$). Furthermore, the second section and the third section of the grounding element are substantially symmetrically identical with each other in another preferred embodiment.

The antenna may be utilized in various portable devices, such as a notebook computer, a mobile phone or a PDA, and all of these portable devices may utilize the antenna to transmit and receive wireless signals. The portable device comprises the antenna and a wireless networking module electrically connected thereof to achieve the function of transmitting and receiving wireless signals.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
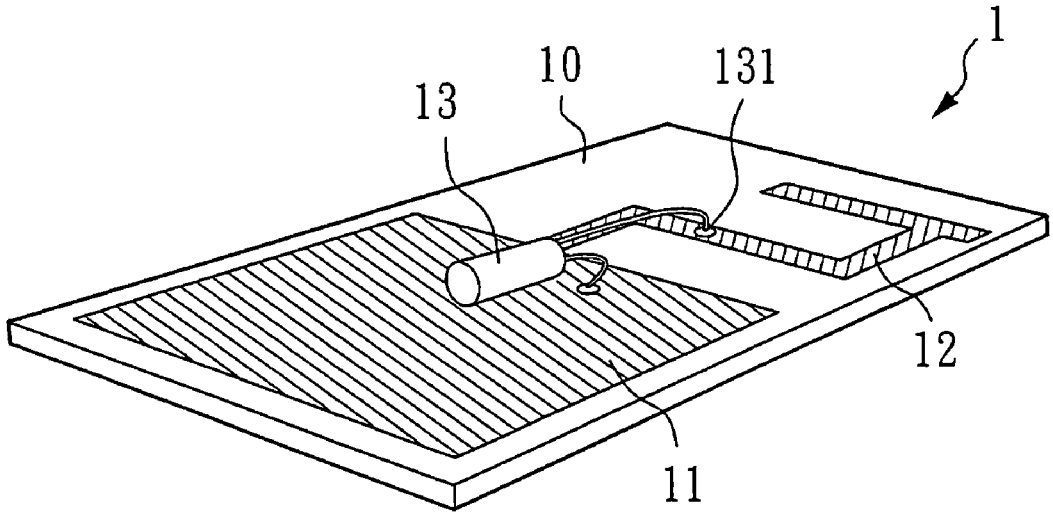
FIG. 1 PRIOR ART
FIG. 1 is a schematic view of a prior art antenna.
Figure 2:
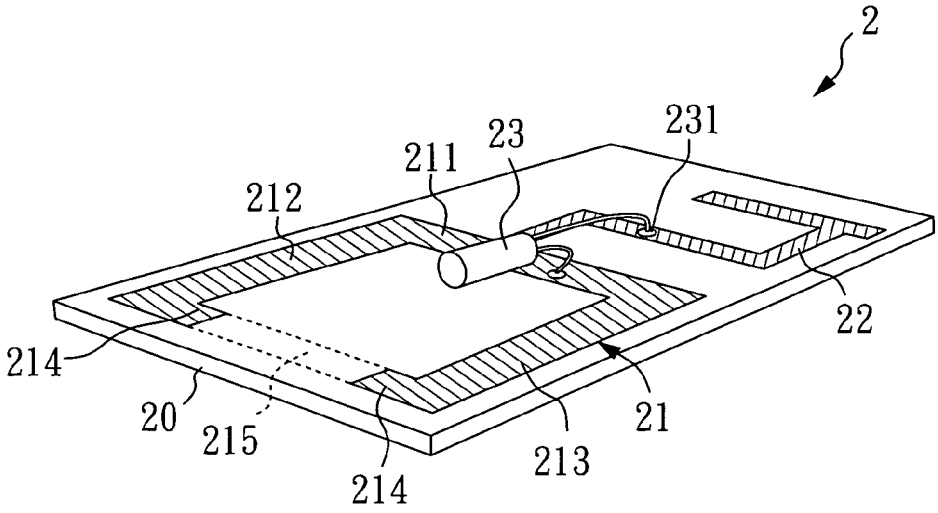
FIG. 2 is a schematic view of an antenna of the present invention.

Please refer to FIG. 2. FIG. 2 is a schematic view of an antenna of the present invention. The present invention provides an antenna 2 which can change its radiation pattern by changing the shape of a grounding element 21. The antenna 2 comprises a substrate 20, a radiating element 22 and a grounding element 21. The radiating element 22 and the grounding element 21 are mounted on the substrate 20 and electrically connected to each other. A coaxial cable 23 is electrically connected to the grounding element 21 and to the radiating element 22 and feeds electronic circuit by a feed point 231.

Figure 3A:
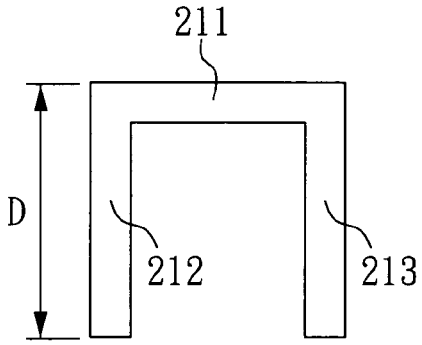
FIG. 3A-FIG. 3D are top views of different grounding elements of an antenna of the present invention.

The grounding element 21 has a first section 211, a second section 212 and a third section 213. The first section 211 is separately connected to the second section 212 and the third section 213 so that the grounding element 21 has a substantially upside-down U shape (as shown in FIG. 3A). Preferably, a total length D of the second section 212 or the third section 213 is substantially a quarter wavelength (λ). In a preferred embodiment, the second section 212 and the third section 213 of the grounding element 21 are substantially symmetrically identical.

Figure 3B:
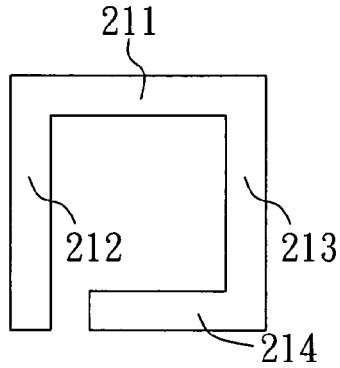
Figure 3C:
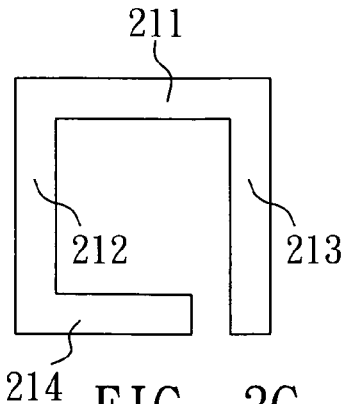
Figure 3D:
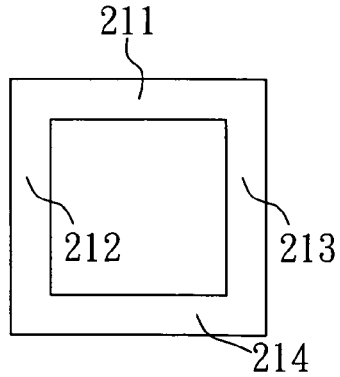

The grounding element 21 may further comprise a fourth section 214, which is connected to the second section 212 and the third section 213 so that the grounding element 21 has a substantially hollowed rectangular shape (as shown in FIG. 3D). In order to provide adjustment for different radiation patterns, the fourth section 214 of the grounding element 21 has an opening 215 that is adjustable. As shown in FIG. 2, the opening 215 can be located at a central portion of the fourth section 214, and different sized openings 215 at different locations can form different radiation patterns.

Alternatively, the fourth section 214 may be connected to the second section 212 or the third section 213, and the grounding element 21 may form a shape with a breach, as shown in FIG. 3B and FIG. 3C. For different radiation patterns, the size of the opening 215 shown in FIG. 2 can be adjusted, or the length of the fourth section 214 shown in FIG. 3B or FIG. 3C can be changed as well (which will change the size of the breach). The current distribution will change with the different shapes of the grounding element 21, which will also change the respective radiation patterns.

Figure 4A:
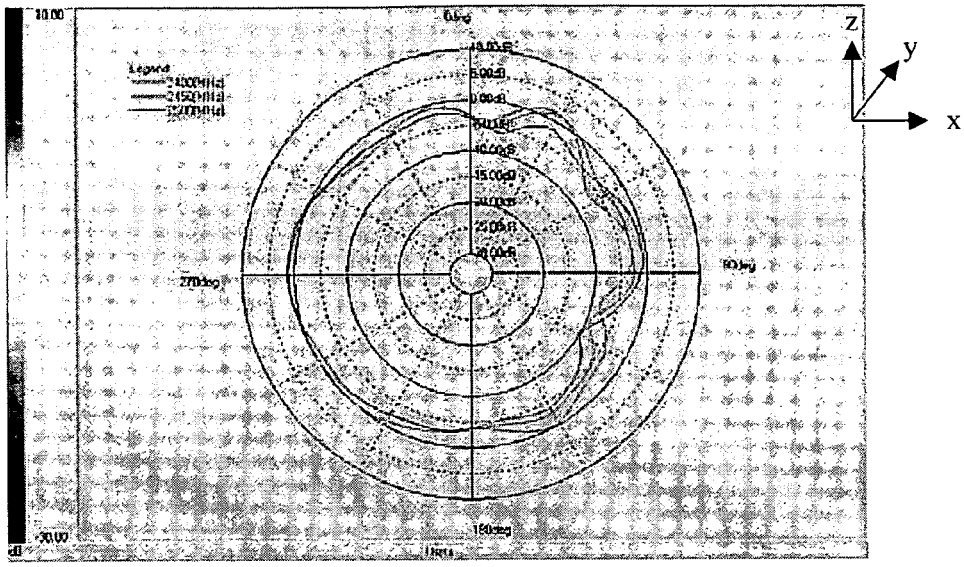
FIG. 4A shows different radiation patterns on an x-z plane at different frequency bands according to FIG. 3A.

Please refer to FIG. 4A. FIG. 4A shows radiation pattern changes on an x-z plane at different frequency bands according to FIG. 3A. In FIG. 4A, whether at 2.400 GHz, 2.450 Ghz or 2.500 GHz, radiation pattern changes on the x-z plane are all omni-directional.

Figure 4B:
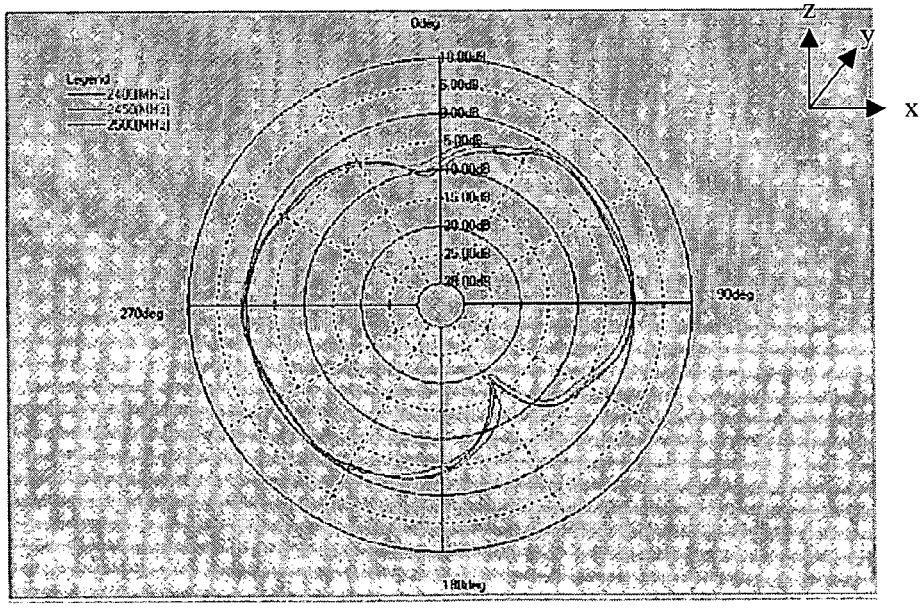
FIG. 4B shows different radiation patterns on an x-z plane at different frequency bands according to FIG. 2.

When grounding element 21 includes a fourth section 214, and an opening 215 of the fourth section 214 is located in the central region of the fourth section 214, as shown in FIG. 2, the corresponding radiation pattern is shown in 4B. In FIG. 4B, whether at 2.400 GHz, 2.450 Ghz or 2.500 GHz, the radiation pattern changes on the x-z plane are all directional.

Figure 4C:
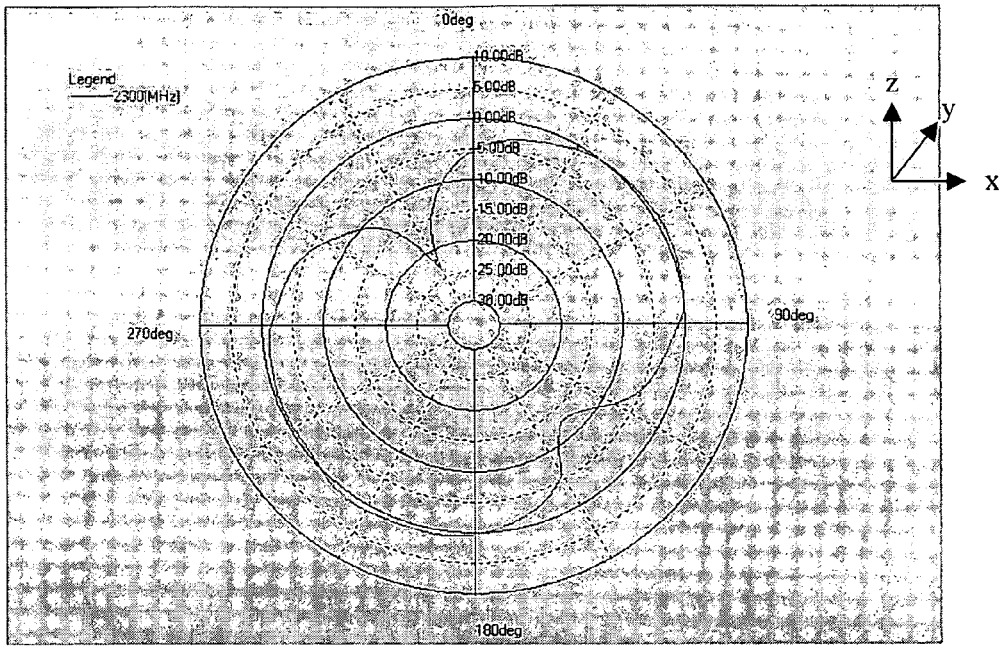
FIG. 4C shows different radiation patterns on an x-z plane at a 2.300 GHz frequency band according to FIG. 3B.
Figure 4D:
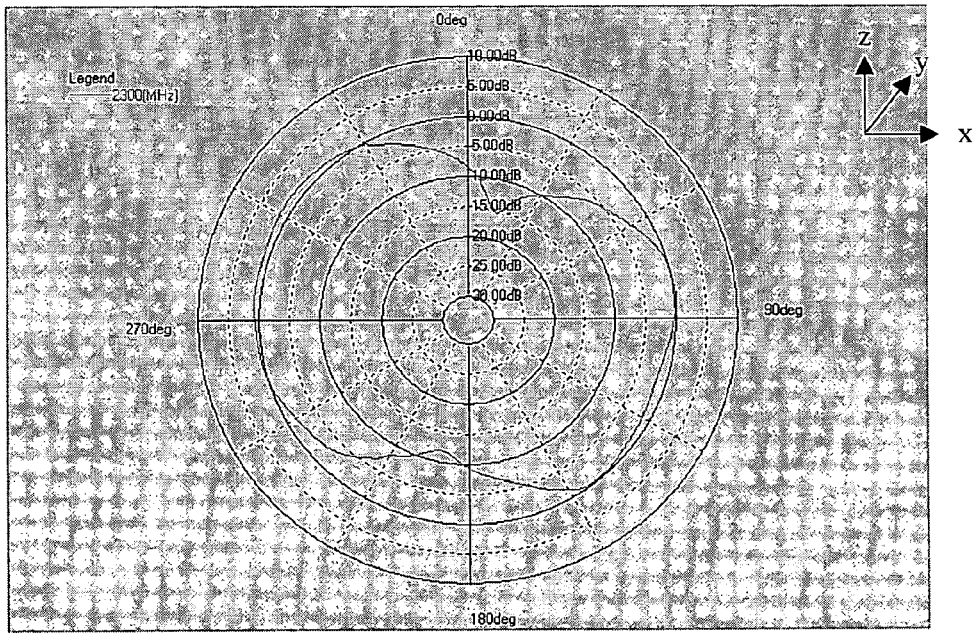
FIG. 4D shows different radiation patterns on an x-z plane at a 2.300 GHz frequency band according to FIG. 3C.

When the fourth section 214 is connected only to the third section 213, as shown in FIG. 3B, it has a radiation pattern as shown in FIG. 4C. In FIG. 4C, at 2.300 GHz, the radiation pattern changes on the x-z plane are directional (oblique). Similarly, when the fourth section 214 is only connected to the second section 212, as shown in FIG. 3C, it has a radiation pattern as shown in FIG. 4D. In FIG. 4D, at 2.300 GHz, the radiation pattern changes on the x-z plane are directional (oblique).

Figure 5A:
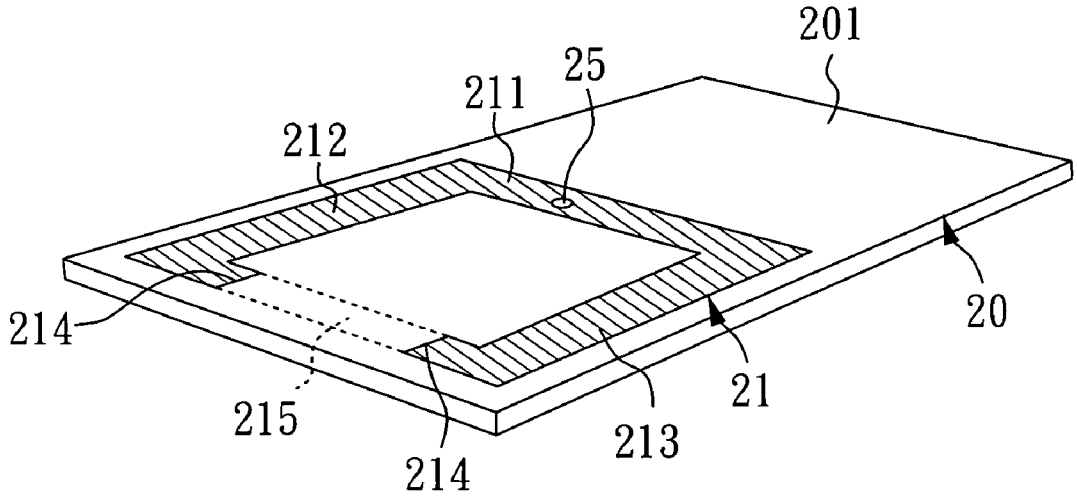
FIG. 5A and FIG. 5B are schematic views showing a grounding element and a radiating element mounted on two opposite faces of a substrate according to an embodiment of the present invention.
Figure 5B:
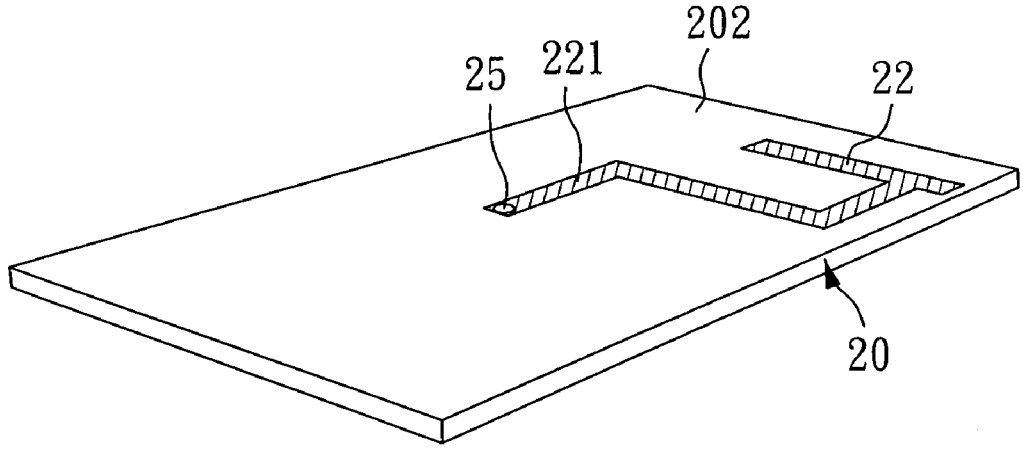
Figure 6A:
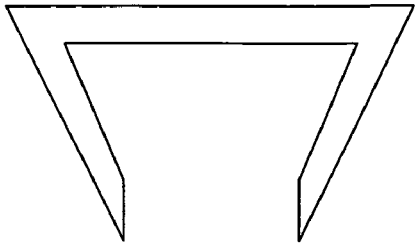
FIG. 6A-FIG. 6D.
Figure 6B:
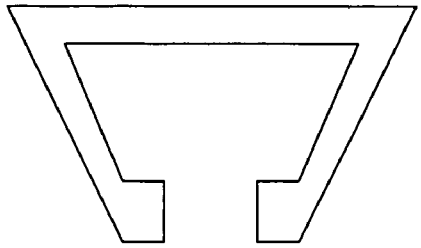
Figure 6C:
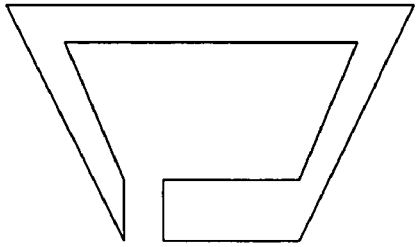
Figure 6D:
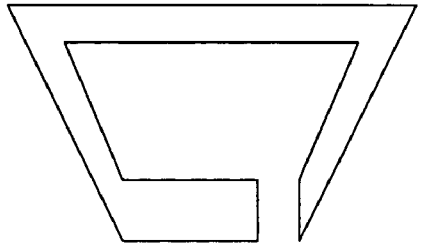
Figure 7A:
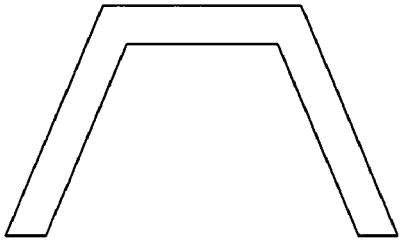
FIG. 7A-FIG. 7D.
Figure 7B:
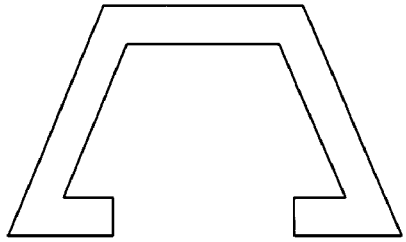
Figure 7C:
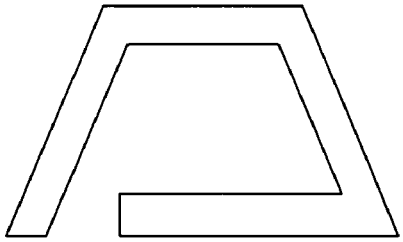
Figure 7D:
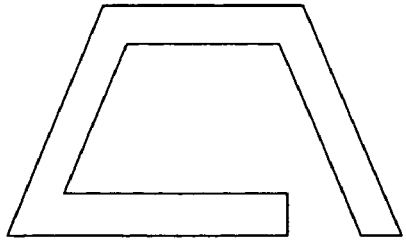
Figure 8A:
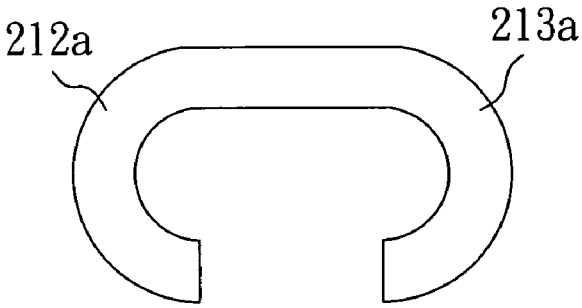
FIG. 8A-FIG. 8D.
Figure 8B:
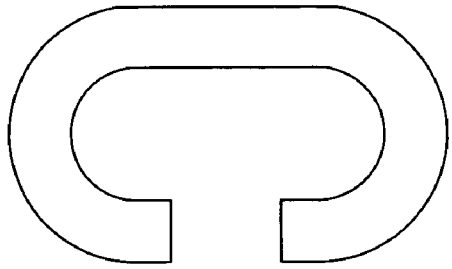
Figure 8C:
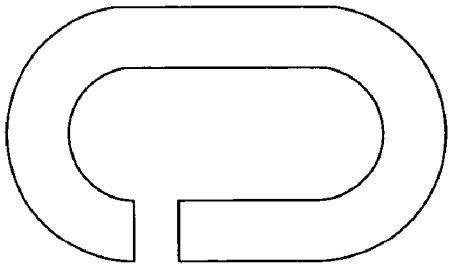
Figure 8D:
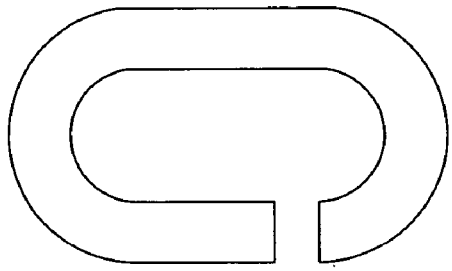
Figure 9A:
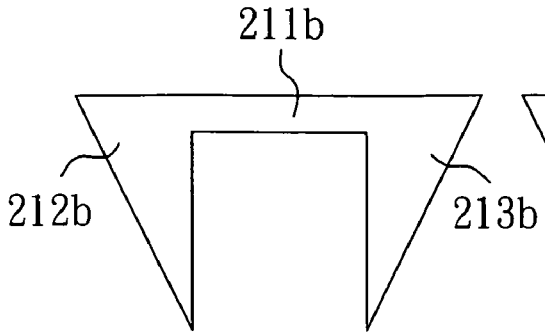
FIG. 9A-FIG. 9D.
Figure 9B:
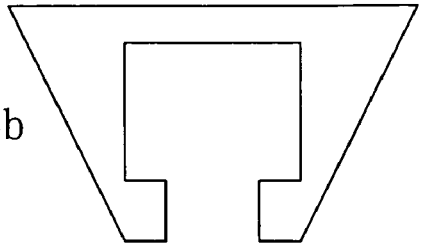
Figure 9C:
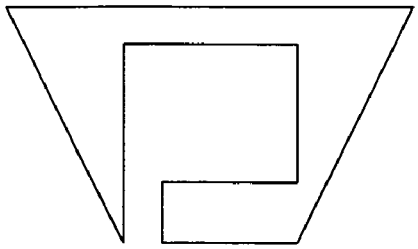
Figure 9D:
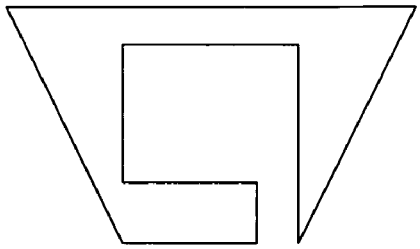
Figure 10A:
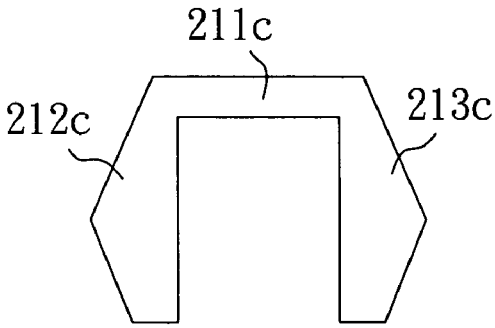
FIG. 10A-FIG. 10D.
Figure 10B:
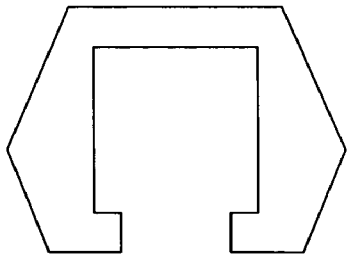
Figure 10C:
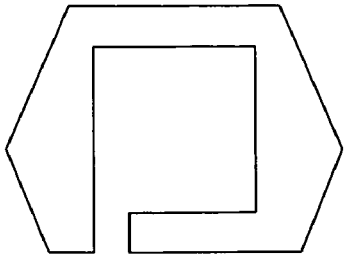
Figure 10D:
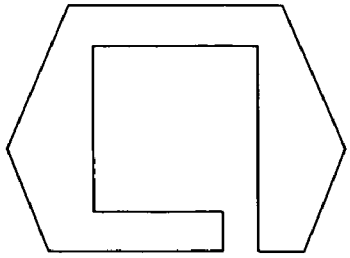
Figure 11A:
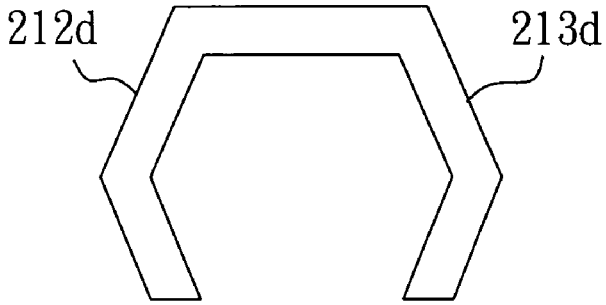
FIG. 11A-FIG. 11D.
Figure 11B:
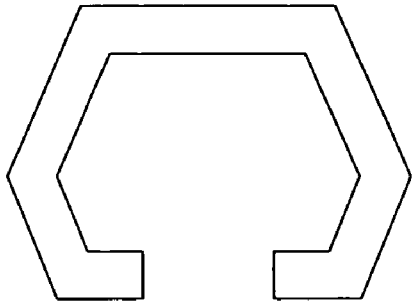
Figure 11C:
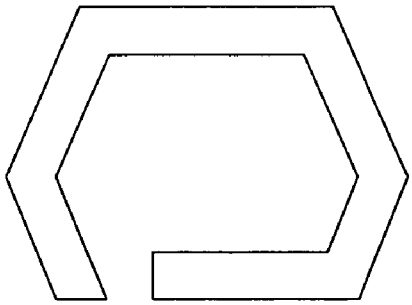
Figure 11D:
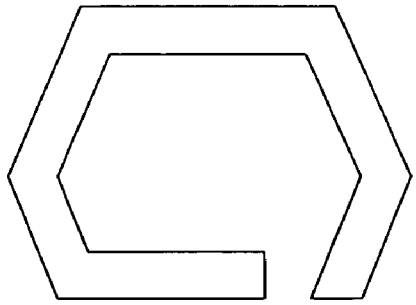

For other embodiments, please refer to FIG. 5A and FIG. 5B. The substrate 20 comprises a first surface 201 and a second surface 202, and the first surface 201 and the second surface 202 are separately located on two opposite faces of the substrate 20. The grounding element 21 is mounted on the first surface 201, and the radiating element 22 is mounted on the second surface 202. Since the grounding element 21 and the radiating element 22 are separately mounted on difference surfaces 201, 202 of the substrate 20, the substrate 20 may further comprise a conductive aperture 25, which is used to connect the grounding element 21 with the radiating element 22. The conductive aperture 25 is located on the grounding element 21 (as shown in FIG. 5A) and is also located at an end of a grounding end 221 of the radiating element 22 (as shown in FIG. 5B), and the conductive aperture 25 can thus electrically connect the grounding element 21 and the radiating element 22.

In different embodiments, the grounding element 21 may have different shapes to provide different radiation patterns. For example, as shown in FIG. 2 and FIG. 3A~3C, an angle formed by connecting the first section 211 of the grounding element 21 to the second section 212 and the third section 213 of the grounding element 21 can be changed. Please refer to FIG. 6A~6D and FIG. 7A~7D; the shape of the grounding element 21 can be changed from the rectangular shape shown in FIG. 2 and FIG. 3A~3C to a trapezoid-like shape by changing the aforementioned angle.

Please refer to FIG. 8A~8D; the second section 212*a* or the third section 213*a* of the grounding element 21 may also be arc-shaped. Alternatively, as shown in FIG. 9A~9D and FIG. 10A~10D, the area of the second section 212*b* or 212*c* of the grounding element 21 may be larger than the first section 211*b* or 211*c*, or the area of the third section 213*b* or 213*c* may be larger than the first section 211*b* or 211*c*. Preferably, the second section 212*b* or the third section 213*b* of the grounding element 21 have triangular shapes, as shown in FIG. 9A~9D; or, as shown in FIG. 10A~10D, the second section 212*c* or the third section 213*c* of the grounding element 21 may have polygonal shapes (such as pentagonal). Similarly, the second section and the third section may have semicircular shapes (not shown).

Figure 12A:
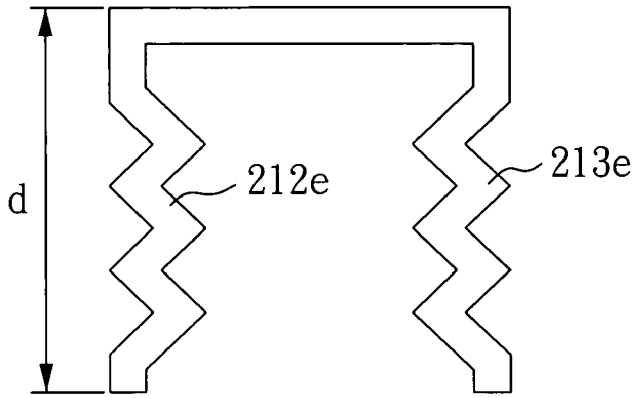
FIG. 12A-FIG. 12C are top views of a grounding element in an antenna according to different embodiments of the present invention.
Figure 12B:
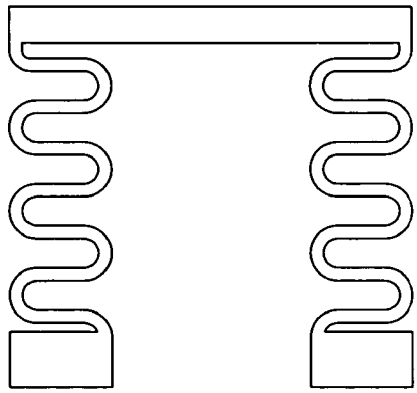
Figure 12C:
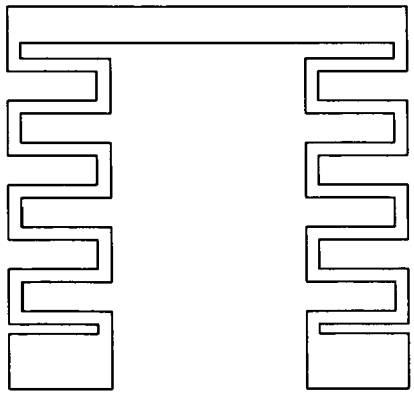

Please refer to FIG. 11A~11D and FIG. 12A~12C; the second section 212*d* or 212*e* of the grounding element 21, or the third section 213*d* or 213*e* of the grounding element 21 can have different zigzagged shapes, and in other embodiments, the fourth section may be added to the antennas shown in FIG. 12A~12C (not shown).

As shown in FIG. 3A, a total length D of the second section 212 or the third section 213 is substantially a quarter wavelength (λ). Therefore, a total length of the second section 212*d* or 212*e* with the zigzagged shape, or a total length of the third section 213*d* or 213*e* with the zigzagged shape, are also a quarter wavelength (λ), and so its lateral length d is smaller than a quarter wavelength, λ, ("D" is indicated in FIG. 3A). That is, the total zigzagged length of the second section 212*d* or 212*e* having the zigzagged shape and the third section 213*d* or 213*e* with the zigzagged shape is equal to one quarter wavelength (λ). Since the lateral length d is shorter (as compared to the prior art grounding element 11), the entire area of the grounding element 21 may be reduced, and so the entire area of the antenna 2 may also be reduced.

Without departing from the spirit and scope of the invention, all of these disclosed shapes of the grounding element 21 may be combined with each other to provide and even greater number of varieties. For example, all embodiments shown in FIGS. 6~12 can be changed to correspond to the embodiment shown in FIG. 3D, so that the grounding element has a hollowed rectangular shape (not shown).

Figure 13:
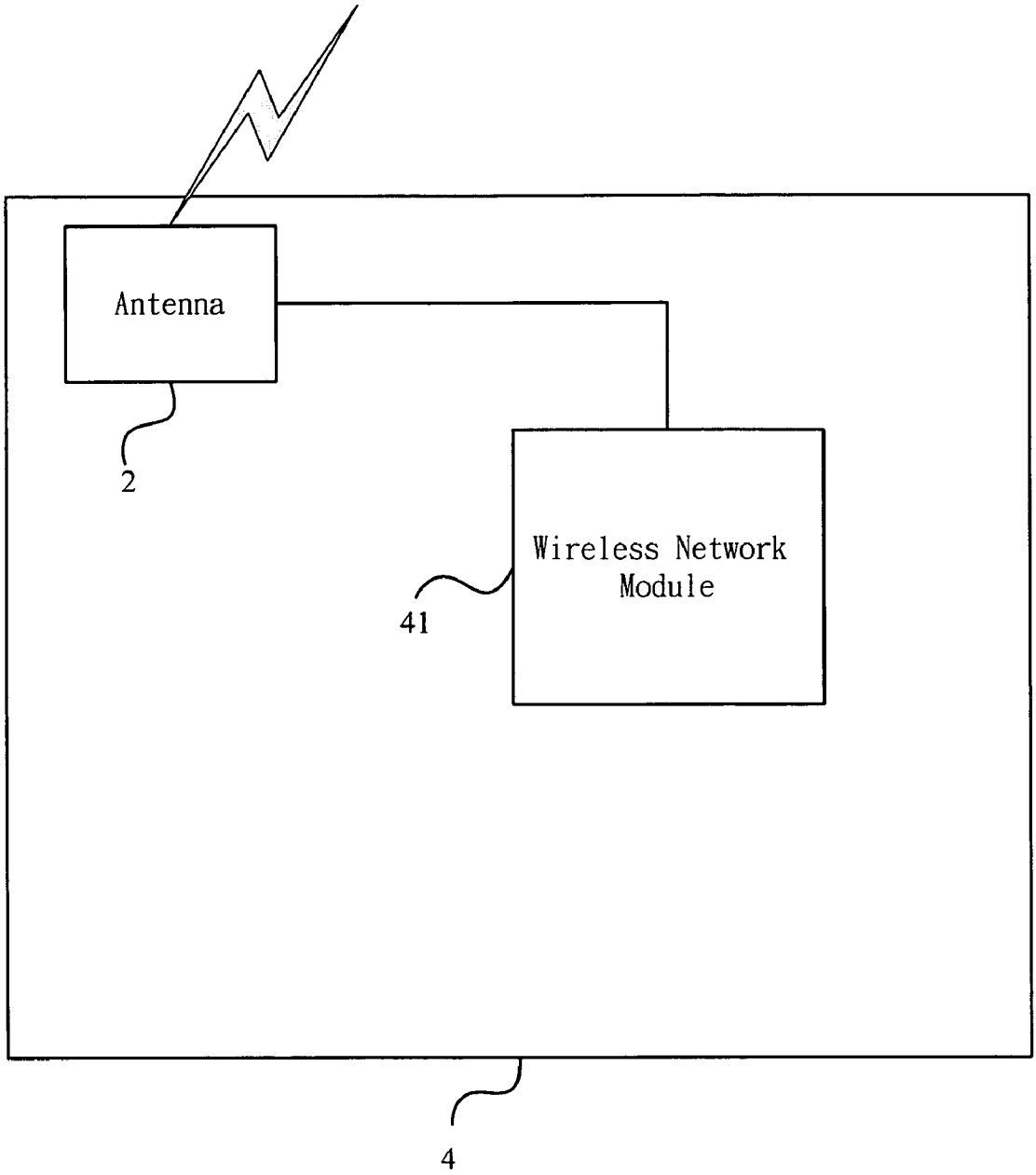
FIG. 13 is a block diagram of a system of a portable device according to the present invention.
Figure 14A:
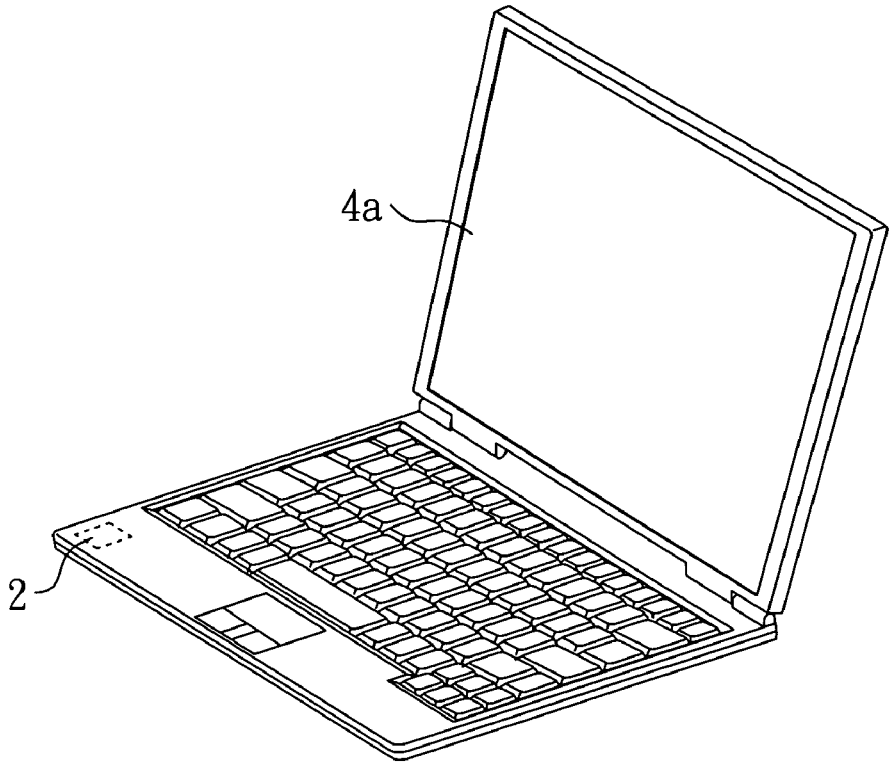
FIG. 14A-FIG. 14C show different embodiments of different portable devices of the present invention.
Figure 14B:
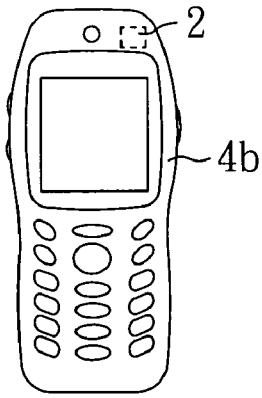
Figure 14C:
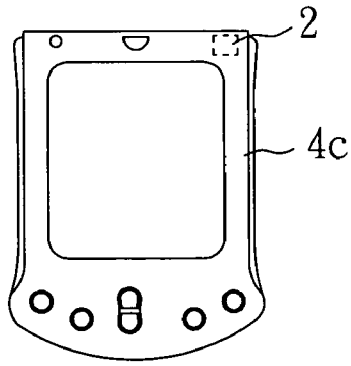

Moreover, the antenna 2 (including all grounding elements 21 in the various embodiments) may be utilized in various portable devices 4. As shown in FIG. 13, the portable device 4 is capable of transmitting and receiving wireless signals and comprises the antenna 2 and a wireless network module 41 electrically connected thereof. The portable device 4 can receive and send wireless signals to the wireless network module 41 via the antenna 2, and signals from the wireless network module 41 can also be transmitted to other devices (not shown) via the antenna 2. With reference to FIGS. 14A~14C, the portable device 4 may be a notebook computer 4*a*, a mobile phone 4*b* or a PDA 4*c*, and all of these portable device 4*a*, 4*b* or 4*c* may utilize the antenna 2 to transmit and receive wireless signals. Moreover, the antenna 2 may be mounted at different positions, and not just at the positions shown in FIGS. 14A~14C; that is, the position of the antenna 2 may depend on the layout design of the portable device 4.

Although the present invention has been explained in relation to its preferred embodiment, it is to be understood that many other possible modifications and variations can be made without departing from the spirit and scope of the invention as hereinafter claimed.

What is claimed is:

1. An antenna comprising:

a substrate;

a radiating element mounted on the substrate;

a grounding element mounted on the substrate, the grounding element electrically connected to the radiating element, the grounding element having a first section, a second section and a third section, wherein the first section is separately connected to the second section and the third section;

wherein the grounding element further comprises a fourth section connected to the second section or the third section;

wherein the fourth section is connected to the second section and the third section, and wherein the fourth section has an opening.

2. The antenna as claimed in claim 1, wherein the opening of the fourth section is located in a central region of the fourth section.

3. The antenna as claimed in claim 1, wherein the area of the second section is larger than that of the first section of the grounding element, and the area of the third section is larger than that of the first section of the grounding element.

4. The antenna as claimed in claim 1, wherein the second section and the third section of the grounding element are substantially symmetrically identical with each other.

5. The antenna as claimed in claim 1, wherein the second section or the third section of the grounding element is substantially arc-shaped.

6. The antenna as claimed in claim 1, wherein the second section or the third section of the grounding element is substantially polygonal.

7. The antenna as claimed in claim 1, wherein the substrate has a first surface and a second surface, the first surface and the second surface separately located on opposite faces of the substrate, the grounding element mounted on the first surface and the radiating element mounted on the second surface.

8. An antenna comprising:

a substrate;

a radiating element mounted on the substrate;

a grounding element mounted on the substrate, the grounding element electrically connected to the radiating element, the grounding element having a first section, a second section and a third section, wherein the first section is separately connected to the second section and the third section;

wherein the second section or the third section of the grounding element has a substantially zigzagged shape.

9. The antenna as claimed in claim 8, wherein a total length of the second section or the third section is substantially quarter wavelength (λ).

10. The antenna as claimed in claim 9, wherein the substrate further comprises a conductive aperture used for electrically connecting the radiating element and the grounding element.

11. A portable device capable of transmitting and receiving wireless signals, the portable device comprising:

a wireless network module; and an antenna electrically connected to the wireless network module, the antenna comprising:

a substrate;

a radiating element mounted on the substrate;

a grounding element mounted on the substrate, the grounding element electrically connected to the radiating element, the grounding element having a first section, a second section and a third section, wherein the first section is separately connected to the second section and the third section;

wherein the antenna is able to receive and transmit the wireless signals to the wireless network module, and the wireless network module is capable of transmitting a signal via the antenna;

wherein the grounding element further comprises a fourth section connected to the second section or the third section;

wherein the fourth section is connected to the second section and the third section. and wherein the fourth section has an opening.

12. The portable device as claimed in claim 11, wherein the portable device is a notebook computer, a mobile phone, or a PDA.

13. The portable device as claimed in claim 11, wherein the substrate has a first surface and a second surface, the first surface and the second surface separately located on opposite faces of the substrate, the grounding element mounted on the first surface and the radiating element mounted on the second surface.

14. The portable device as claimed in claim 13, wherein the substrate further comprises a conductive aperture for electrically connecting the radiating element and the grounding element.

* * * * *